United States Patent [19]

Bray et al.

[11] Patent Number: 4,746,313

[45] Date of Patent: May 24, 1988

[54] WEBBED SWIMMING AID

[75] Inventors: Ken W. Bray, 6313 Shelter Creek, San Bruno, Calif. 94066; Sandra Rhodes, Berkeley; Richard Mayers, Richmond, both of Calif.

[73] Assignee: Ken W. Bray, San Diego, Calif.

[21] Appl. No.: 88,988

[22] Filed: Aug. 21, 1987

Related U.S. Application Data

[63] Continuation of Ser. No. 946,668, Dec. 31, 1986, abandoned, which is a continuation of Ser. No. 727,694, Jan. 26, 1985, abandoned.

[51] Int. Cl.[4] ..... A63B 31/04

[52] U.S. Cl. ..... 441/57; 441/58

[58] Field of Search ..... 441/58, 57, 56; 2/159, 2/161 A, 162

[56] References Cited

U.S. PATENT DOCUMENTS

| | | | |
|---|---|---|---|
| 1,008,117 | 11/1911 | Copeland et al. | 441/57 |
| 1,625,730 | 4/1927 | Lake | 441/57 |
| 1,746,268 | 2/1930 | Lepetich | 441/57 |
| 1,888,867 | 11/1932 | Schmitt | 441/57 |
| 2,556,894 | 6/1951 | Axiotes | 441/61 |
| 2,704,372 | 3/1955 | Criger | 441/57 |
| 3,231,910 | 2/1966 | Tegland | 441/57 |
| 3,263,248 | 8/1966 | Wendorf | 441/57 |
| 3,333,280 | 8/1967 | Hynek et al. | 2/266.1 |
| 3,938,207 | 2/1976 | Drescher | 441/57 |
| 4,058,863 | 11/1977 | Ferdico | 441/57 |
| 4,121,312 | 10/1978 | Penney | 441/57 |
| 4,193,135 | 3/1980 | Rhee | 2/162 |
| 4,195,365 | 4/1980 | Eyman | 441/57 |

FOREIGN PATENT DOCUMENTS 0364864 3/1939 Italy .

*Primary Examiner*—Joseph F. Peters, Jr.
*Assistant Examiner*—Ed L. Swinehart
*Attorney, Agent, or Firm*—James E. Eakin

[57] ABSTRACT

A webbed swimming aid formed from two planar sheets shaped to conform generally to the shape of an outspread hand from a first sheet of elastic, mesh material and a second sheet of thin, stiff, water impermeable material. Truncated finger stalls are provided by stitching or sealing regions along the upper edge of the sheets towards the palm portion of the aid. Webbing edge of second sheet, or, alternatively, may be sealed within the triangular webbed regions sewn or sealed along the upper edge of the aid with apices of the triangles directed towards the palm portion of the aid to define the finger stalls.

20 Claims, 1 Drawing Sheet

WEBBED SWIMMING AID

This is a continuation of application Ser. No. 946,668, filed Dec. 31, 1986 and now abandoned, which is a continuation of application Ser. No. 727,694, filed Jan. 26, 1985, now abandoned.

BACKGROUND OF THE INVENTION

Mankind has long envied the duck and frog for their superior aquatic abilities. To mimic the advantages of their webbed appendages, it is common for swimmers and divers to strap swim fins on their feet. Along the same lines, a number of webbed device to be worn on the hands have been proposed, none gaining the universal usage that swim fins have earned.

Water sports have grown in popularity and variety in the past decade. In particular, some water sports, such as surfing, specifically require only paddling with the hands. Other well known water sports, such as swimming, body surfing, snorkeling and scuba diving, require both the hands and feet to generate motion. All of these activities would be enhanced by adding webbed hands.

Athletic training regimens have also become more sophisticated and demanding. For instance, swimming race events such as the triathlon require enhanced upper body and arm strength which could be accelerated by wearing webbed devices on the hands during training.

The prior art teaches a variety of swimmer's gloves and mitts and the like, for example such as those disclosed in U.S. Pat. Nos. 4,121,312; 4,058,863; 3,938,207; 3,874,014; 3,263,248; 3,231,910; and others.

The prior art teaches a variety of swimming aids which provide webbed areas between the thumb and index finger and between the rest of the fingers of a swimmer's hand. The objectives of the prior art are either accomplished through a number of over-inclusive features which result in overly complex and expensive fabrication costs or overly simplistic elements which do not survive the rigors of active swimming.

Rigid paddles have also been used in certain water sports such as kayaking. However, such rigid paddles were simply strapped to the wearer's hands, and were effectively only oars without handles. These paddles caused fatigue and discomfort and do not have the flexibility required for the other discussed activities.

Providing webbing between the thumb and fingers of a swimmer's hand provides improved swimming abilities by increasing the amount of fluid displaced by each stroke of the swimmer's hand. The additional resistance afforded by such webbing is advantageous in the training of swimmers in that it improves the swimmer's control, thereby buoying the swimmer's confidence in his abilities and builds muscle tone due to the additional effort required to move the arm through the water.

SUMMARY OF THE INVENTION

The present invention provides an inexpensive, portable webbed swimming aid to be worn on the hands while swimming or participating in other water sports. This swimming aid performs the functions of a paddle while providing the comfort and flexibility of gloves. Grasping objects, scratching an itch, and other feats of manual dexterity are still possible as the fingertips are exposed. Thus, the swimming aid provides improved fluid displacement of the wearer's hands without impeding other activities which require use of the hands.

The webbed swimming aid of the invention is constructed of two superimposed planar sheets which are easily sized to a variety of sizes. One sheet, the back side of the swimming aid, is cut from an elastic, porous, mesh material which customizes the aid and acts as a glove to snugly fit the wearer's hand. The second sheet, the palm portion of the swimming aid, is made of somewhat rigid yet flexible, water resistant or water impermeable material.

The two sheets are cut into fan shaped pieces which generally conform to the shape of an outspread hand. To construct the webbed aid, stitching or other well known means are used to join the outermost side edges of the swimming aid. Open-ended finger stalls spaced apart by closed webbed areas are formed by stitching or sealing areas along the upper edge of the superimposed sheets. In the preferred embodiment, the stitching or sealing means form generally ovoid triangular areas to define the finger stalls. Other stitching patterns such as single lines directed from the fingertip edge towards the wrist portion could also be used to provide extra wide finger stalls that utilize the overall fan shape of the sheets as a singular webbed area. Although the two sheets may be identical in outer dimensions when first cut, with wear, the elastic mesh material may become permanently stretched to be somewhat larger than the second sheet of water resistant or water impermeable material. Such permanent deformation of the first sheet of material is desirable, as it permits the two-dimensional structure of the swimming aid to better adapt to the three-dimensional size variations in human hands.

To be most effective, the swimming aids must be worn on both hands. The swimming aid of the invention is flexible enough to allow the swimmer, after putting on the first of a pair of the swimming aids, to put on the second swimming aid without assistance.

A wrist strap may be provided along the wrist portion of the swimming aid to further secure the device to the swimmer's hands. Complicated closures would not be advisable since more delicate movements are awkward. Elasticized straps, snaps or various hook and loop fasteners have all been found to be satisfactory.

The present invention also permits freedom of movement of the swimmer's exposed fingertips allowing the swimmer to grasp other watersports equipment, such as cameras, surfboards, etc. Exposure of the fingertips also provides psychological benefits to the wearer.

The disclosed invention addresses all of the concerns of the prior art, while reducing the expense of construction of the devices. Costs are minimized since no molding or specialized parts are required. The major components may be cut from two different sheet materials using a single pattern. The patterns are easily designed to fit from infant to adult sizes. The components are joined by a simple stitching or heatsealing device. The resulting product is inexpensive, highly portable (i.e., rolling up to fit in a pocket), adaptable to variations in hand sizes, and very effective. The swimming aid of the present invention may easily be stowed aboard windsurfing boards and water vessels for emergency purposes.

Other features and advantages of the invention will become more apparent from the detailed description to follow.

Referring to the drawings:

DETAILED DESCRIPTION OF THE PREFERRED EMBODIMENT

Figure 1:
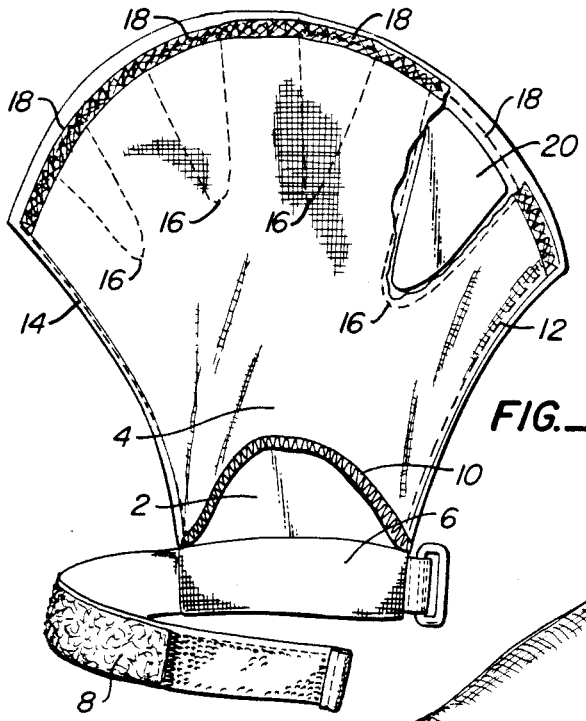
FIG. 1 is a top plan view of the webbed swimming aid.

The webbed swimming aid of this invention is depicted in the preferred embodiment in the drawings. FIG. 1 illustrates the simplicity of the construction from the top plan view.

The structural properties of the sheet materials from which the swimming aids are fabricated are of particular importance. The swimming aid is primarily constructed from two superimposed, fan-shaped planar sheets 2 and 4, which conform generally to the shape of an outspread hand. The lower sheet 2 is constructed of a flexible, relatively stiff, water resistant or water impermeable material. The stiffness is required to withstand the force of the fluids exerted on the webbed areas during swimming. Also, the material must not be so supple as to accordion-fold downwardly along the swimmer's fingers so as to reduce the surface area of the webbing. The upper sheet 4 holds the lower sheet against the wearer's hand. The two sheets are joined along the side edges and have open-ended finger stalls formed by stitched patterns spaced along the sheets.

The normally upper sheet 4 primarily acts as the glove portion of the swimming aid to secure the webbing to the swimmer's hand. This upper sheet material, which is elastic and porous, should permit water to pass through it fairly easily. It should not be very absorbent, since absorbed water would cause the webbed aid to become unnecessarily heavy and might cause the shape of the sheet to deform, causing the fit to be less snug. The elastic mesh material forms the glove portion of the swimming aid that adapts the aid to the size of the particular wearer. Of course, the patterns for cutting the sheet material may be approximately sized to fit a certain range of hand sizes, but it is the elastic quality of this sheet of material which fine tunes the fit. The fit must be snug to prevent slippage along the hand during use. Such slippage is undesirable because of the discomfort to the wearer, as well as the chafing or scraping of the skin which might result over a prolonged period of use. Materials known as Power-Net, available under the trade names Flexa-Vent II and Flexa-Vent III from Quick Service Textiles, as well as Spandex®, have proven to be satisfactory. It has been found that these materials tend to cling fast to the wearer's hands when wet.

Figure 2:
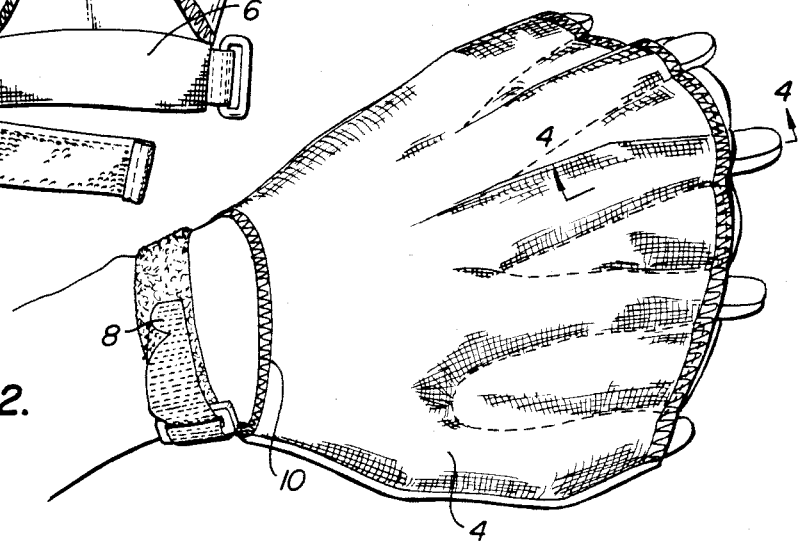
FIG. 2 is a perspective illustration of the webbed swimming aid in use.
Figure 3:
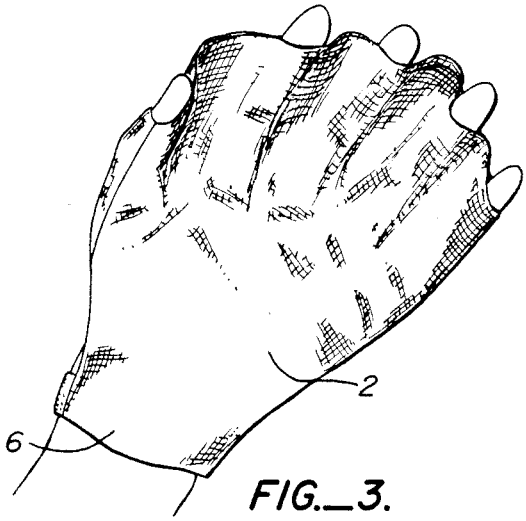
FIG. 3 is a perspective illustration of the underside of the webbed swimming aid in use.

The elastic quality of the material is crucial since the upper sheet 2 must stretch to accommodate the cupped shape of the swimmer's hand for the most effective displacement of fluid during the swimming stroke. This cupped position is illustrated in the perspective views given in FIGS. 2 and 3. FIG. 2 illustrates the position of the upper sheet 4 and FIG. 3 illustrates the lower sheet 2 as seen from below the swimmer's hand.

The normally lower sheet 2 of material must have sufficient rigidity and stiffness to provide webbed surfaces which are firm enough to displace water and withstand the force of the swimmer's stroke. It is to be understood that the webbed surface area must be maximized in order to displace the most water while the aid is being used as a paddle. If the lower sheet of material was so resilient as to collapse or crumple along the finger areas, the effective surface area of the webbing would be reduced, reducing the effectivess of the swimming aid. However, this lower sheet of material must be flexible enough to allow the swimmer to comfortably cup the hand during the swim stroke, thereby further increasing the amount of fluid displaced by each stroke. As previously disclosed, the lower sheet of material must also permit a certain degree of freedom of movement to allow the swimmer to put on the swimming aid without assistance and grasp other objects while wearing the aid. Polyester weave fabric with vinyl coating, heavy duty ballistics cloth with vinyl or urethane coating, Tarp-Lite 3214 or Tarp-Lite 3222 available from the Shelter-Lite Co., and Cordura® nylon with a waterproof coating, have all proven to be satisfactory as the lower sheet material for the purposes of this invention.

Figure 4:
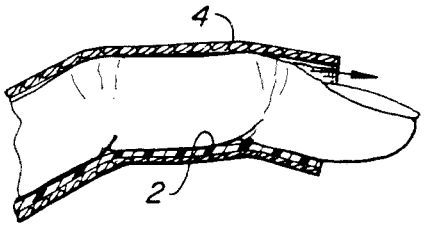
FIG. 4 is a sectional view of the webbed swimming aid taken along the section lines 4—4 in FIG. 2.

FIG. 4 is a sectional view taken along the lines 4—4 in FIG. 2. The fingertip of each finger and the thumb are left exposed while the swimmer wears the swimming aid. The open ended structure of the finger stalls also enhances the universal sizing of the patterns for the aid. Variations in the lengths of fingers in wearers are easily tolerated by this open configuration. This feature also permits the swimmer to easily grasp and manipulate objects such as other water sports accessories, for example cameras, surfboards, boogie boards and the like. For those persons wearing the swimming aid while learning to swim, having the sensitive fingertips exposed enhances the swimmer's sense of security by not inducing a claustrophobic sence of being enclosed by equipment.

It has also been found that the elastic mesh material 4 is less likely to slip along the skin of the hand once the material has become wet. This quality of the material permits the wearer to adjust the position of the swimming aid towards or away from the wrist to some extent depending on the wearer's needs at the particular moment. For instance, while swimming or scuba diving, it is best to wear the aid as far away from the wrist as is comfortable to maximize the additional force generated by the paddle-effect of the outspread webbed hand. While manipulating objects such as underwater cameras or adjusting oxygen tanks, the wearer may, instead of completely removing the aid, pull the aid towards the wrist to expose more of the fingertips.

As is apparent from the figures, the construction of the swimming aid is fairly straightforward. Both sheets are cut from substantially identical fan shaped patterns. The outline of the fan shape conforms generally to the shape of the fully outspread hand. The sheets must be produced in left hand and right hand versions. A range of sizes are easily provided to suit the size of the individual swimmer.

The lower sheet 2 differs in shape from the upper section 4 in that it has a wrist portion 6 to which a wrist band 8 is secured. To allow easy adjustment, the wrist band may be provided with easily adjusted fastening means such as Velcro® hook and loop fasteners. FIG. 1 illustrates a wrist strap 8 formed of lengths of hook and loop fastener tape. The strap 8 is threaded through a loop 9, and is of sufficient length that a hand may be inserted even when the end 11 is threaded through a loop 9. To secure the strap, the wearer need only pull the already threaded end 11 and fold the strap over to engage the hooks and loops. This can be done easily when already wearing an aid on the other hand. A flotation device, such as a small section of closed-pore foam may also be incorporated into the wrist portion of the lower sheet 2 so that the swimming aid will float if inadvertently dropped into the water.

The upper sheet 4 has a curved wrist edge 10 at the wrist edge of the sheet to permit greater freedom of movement and to allow easy insertion of the hand into the aid.

The swimming aid may easily be customized to suit a variety of applications. Different versions of the swimming aid may be constructed according to the specific intended application. For instance, surfers may only need to use the swimming aid when paddling. Surfers would find a version of the swimming aid which is softer, such as one constructed with a second sheet of Cordura® to be most effective. Simpler stitching patterns (such as single lines) might be sufficient to define the finger stalls for aids intended to be worn only for paddling purposes. A softer glove would permit the surfer to easily grasp the board, be comfortable to wear, and yet provide improved paddling ability. Serious swimmers might require varying degrees of stiffness from the swimming aid, depending on the particular swim stroke for which the swimmer is training. For those situations in which it is occasionally desirable to have the fingers together, the webbing must be pliable enough to permit the fingers to be moved together axially.

In some instances, the webbed area may be reinforced by placing triangular shaped stiffeners 5 in the regions between the finger stalls prior to stitching. Such stiffeners would be suitable for enhancing the rigidity of the webbing area where softer material for the bottom sheet of the swimming aid is desirable. FIG. 1 also illustrates such another embodiment of the invention which would include stiffener members 5 sewn within the region defined by the triangular stitching or stitching patterns 16. The stiffener member is cut of a material of the desired rigidity in a generally triangular shape to fit between the upper sheet 2 and lower sheet 4 in the webbing areas separating the various finger stalls.

Another embodiment (not illustrated) of the invention provides for a single arcuate stiffening member to be attached to the fingertip edge of the bottom second sheet of material. The side seams and triangular patterns are then joined in the usual manner. This arcuate stiffening member may be of any stiff, water resistant material, and would counteract any tendency of the webbed regions to collapse downwardly along the fingers. A single stiffening member would permit a softer material to be used as the bottom sheet, without greatly increasing the labor required to construct the aids.

The particular qualities of either type of stiffener members could also be varied according to the particular application.

To manufacture the swimming aid, the upper sheet 4 and lower sheet 2, after all raw edges have been finished to prevent fraying of the material as necessary, are sandwiched according to whether they are to be left handed or right handed. The superimposed sheets are sealed along the thumb side seam 12 and the outer side seam 14 by stitching or other joining means such as heat-sealing.

One method that has been found to facilitate the manufacture of the swimming aid includes gluing the two sheets of material together with a water-soluble glue, rubber cement, or other temporary adhesive, prior to cutting the aids from patterns. This gluing step assures that the layers do not slip and permits the simultaneous cutting of both sheets. The pieces are then finished to the extent possible, depending on the specific features of the embodiment, before the pieces are soaked in water (or other appropriate measures are taken) to remove the adhesive.

The wrist band 8 and a flotation device, if any, is then secured to the wrist section 6 by similar well known means. If a single arcuate stiffener is to be added, it is separately fastened to the bottom sheet of material. The finger stalls are then formed by a series of triangular stitching or fusing patterns 16.

If stiffener members are to be incorporated in the swimming aid, the sides of each triangular pattern 16 may be first stitched to form a pocket for the stiffener member 20. The stiffener member 20 may then be inserted, and the upper edge of the pattern 16 stitched or sealed at 18. The shapes of the stitching patterns in this preferred embodiment are designed to seal the upper edges 18 of the webbed areas to enhance the rigidity of the webbed areas and the swimming aid as a whole. It is to be understood that a variety of stitching patterns could be used to accomplish the requirements for which the particular aid is intended.

As would be apparent to those skilled in the art, the overall shape of the planar upper sheet 4 and lower sheet 2 must be approximately sized to accommodate the three-dimensional structure of the wearer's hands. Thus, the placement of the stitching triangles 16 must account for sufficient ease in the size of the finger stalls to accommodate the anticipated size range of fingers.

The foregoing is a complete description of the invention. The above is not intended to limit the scope of the invention disclosed herein. Other modification and variation can be made to the disclosed embodiment without departing from the subject of the invention as defined in the following claims.

What is claimed is:

1. A webbed swimming aid comprising:

a first sheet of an elastic, thin, flexible, water permeable mesh material substantially shaped to conform generally to the shape of the back of an outspread hand;

a second sheet of thin, flexible, water impermeable material relatively stiffer than the first sheet and shaped to conform generally to the shape of the palm side of an entire outspread hand excepting the fingertips and having a wrist portion, the second sheet having sufficient stiffness to help maintain the fingers in a spread apart position during swimming;

means for joining the outermost side edges of said first sheet and said second sheet whereupon said first sheet and said second sheet are held in a superimposed relationship and define truncated, open-ended finger stalls with the first sheet arranged to contact the back of the hand and the second sheet arranged to contact the palm of the hand.

2. The webbed swimming aid of claim 1, further comprising adjustable wrist-fastening means fixedly attached to said second sheet.

3. The webbed swimming aid of claim 2, wherein said wrist-fastening means comprises mating hook and loop fastener straps.

4. The webbed swimming aid of claim 1, wherein said first sheet is shaped with an inwardly arcuate portion at the wrist edge to facilitate insertion of the hand and allow greater freedom of movement of the swimmer's cupped hand.

5. The webbed swimming aid of claim 1, wherein means for joining areas of the superimposed first and second sheets further comprises stitching of generally triangular areas, with the apices of the trangles directed towards the palm of the swimming aid to form open-ended finger stalls with webbed regions therebetween.

6. The webbed swimming aid of claim 5, further comprising generally triangular stiffening members retained within said generally traingular areas between the finger stalls.

7. The webbed swimming aid of claim 1, further comprising a flotation device fixedly mounted to a wrist portion of said aid.

8. The webbed swimming aid of claim 7, wherein said flotation device comprises a strip of closed-pore foam retained along the wrist section of said second sheet.

9. A method for constructing a webbed swimming aid in a left-handed version and right-handed version comprising the steps of:

(a) providing a first sheet of elastic, thin, water permeable mesh material and a second sheet of stiff, thin, water resistant material;

(b) providing patterns of predetermined sizes shaped to conform generally to the shape of an entire outspread hand from the wrist up to just below the tips of the fingers;

(c) cutting said first and second sheets in accordance with said patterns;

(d) superimposing the first and second sheets with thier respective sides registered with the first sheet registered to be in contact with the back of the hand and the second sheet registered to be in contact with the palm of the hand;

(e) joining the sides of the superimposed first and second sheets; and (f) bonding the superimposed first and second sheets in triangular patterns along their upper edge such that the apices of the triangles point generally towards the wrist portion of said sheets and the open spaces between the sides of the triangles define truncated thumb and finger stalls.

10. The method of claim 9, further comprising the step of securing wrist-fastening means to said second sheet.

11. The method of claim 9, further comprising the step of fixedly mounting an arcuate stiffener member to the normally fingertip edge of said second sheet.

12. The method of claim 9, further comprising the step of placing webbing stiffener members between said first and second sheets in the areas between each of the finger stalls before the upper edge of each of said triangular patterns has been sealed.

13. The method of claim 9, further comprising the step of securing a flotation device to the wrist portion of said second sheet.

14. A hand fin for use in swimming and other aquatic sports comprising:

a sheet of a first material shaped substantially in the form of the entire palm side of an outspread hand excepting the fingertips, said first material being thin, substantially impermeable to water, sufficiently stiff as to help maintain the fingers in a spread apart position during swimming and to not substantially deform when thrust into or pulled through the water, and sufficiently flexible as to conform substantially to the arc of the fingers during aquatic sports, a sheet of a second material shaped to conform to at least the outspread fingers of the hand, said second material being readily water permeable and sufficiently elastic and flexible as to position, in a substantially fixed manner, the hand fin on the hand, said first sheet being relatively stiffer than said second sheet, the first and second sheets being attached to one another sufficiently to define passageways therebetween for the thumb and fingers, said passageways being open-ended to permit at least the tips of the fingers to extend therebeyond.

15. The invention of claim 14 further comprising:

strap means adapted for connection to the sheet of first material for attaching the hand fin to the wrist of a user.

16. A hand fin swimming aid comprising:

a first sheet of a thin, stiff, flexible, substantially water impermeable material shaped to conform substantially to the shape of the entire palm side of an outspread hand except the fingertips, a second sheet of an elastic, thin, flexible, porous material shaped to conform generally to at least the outspread fingers and a portion of back of the palm, the first sheet being relatively stiffer than the second sheet, connecting means for affixing the first and second sheets together to define passageways therebetween for the thumb and fingers, said passageways being open-ended to permit at least the tips but not substantially more than the outermost phalange of the fingers to extend therethrough.

17. The invention of claim 16 wherein the second sheet is a mesh material.

18. The invention of claim 16 further comprising flotation means affixed to the first sheet for causing the hand fins to float when not in use.

19. A hand fin comprising:

a first sheet of a thin, flexible, substantially water impermeable material shaped to conform substantially to the shape of the entire palm of an outspread hand excepting the fingertips, a second sheet of an elastic, thin, flexible, highly porous material shaped to conform generally to at least the outspread fingers and a portion of the back side of the palm, the first sheet being relatively stiffer than the second sheet, connecting means for affixing the first and second sheets together to define passageways therebetween for the thumb and fingers, said passageways being open-ended to permit at least the tips but not substantially more than the outermost phalange of the fingers to extend therethrough, a plurality of inserts of a stiffening material maintained within the interstitial spaces between the outspread fingers to cause the hand fin to be sufficiently stiff as to not substantially deform when thrust into a pulled through the water.

20. A hand fin comprising:

a first sheet of a thin, substantially water impermeable material shaped to conform substantially to the shape of the entire palm of an outspread hand excepting the fingertips, the material having sufficient stiffness as to help to maintain the fingers in a spread apart position during swimming and sufficient flexibility as to conform to the natural arc of the hand during swimming, a second sheet of a thin, elastic and highly porous material shaped to conform to at least a portion of the back of the fingers and capable of affixing the hand fin to the hand of the user while at the same time permitting water to pass readily therethrough so as not to create unnecessary drag, the first sheet being relatively stiffer than the second sheet, binding means for affixing the first sheet to the second sheet to provide a substantially completely covered palm surface together with truncated finger stalls and webbed areas therebetween, and a wrist strap means affixed to the first sheet for fastening the palm portion thereof to the wrist.

* * * * *